United States Patent [19]

Fullerton

[11] Patent Number: 4,607,844

[45] Date of Patent: Aug. 26, 1986

[54] POKER MACHINE WITH IMPROVED SECURITY AFTER POWER FAILURE

[75] Inventor: Graeme D. Fullerton, Beverly Hills, Australia

[73] Assignee: Ainsworth Nominees Pty. Ltd., Rosebery, Australia

[21] Appl. No.: 803,969

[22] Filed: Dec. 3, 1985

[30] Foreign Application Priority Data

Dec. 13, 1984 [AU] Australia ..... PG8554

[51] Int. Cl.[4] ..... A63F 5/04

[52] U.S. Cl. ..... 273/143 R; 273/138 A

[58] Field of Search ..... 273/143, 138; 371/66

[56] References Cited

U.S. PATENT DOCUMENTS 3,890,494 6/1975 Meshek et al. ..... 371/66

*Primary Examiner*—Richard C. Pinkham

*Assistant Examiner*—Stuart W. Rose

*Attorney, Agent, or Firm*—Murray and Whisenhunt

[57] ABSTRACT

A poker or slot machine in which security is provided against tampering by monitoring the status of the reels of the machine and storing the status in a non-volatile memory. In the event of a power failure, the control unit of the machine tests the status of the reels upon power up and if the position of the reels is different to that indicated by the status held in the non-volatile memory, an alarm is initiated. If the status stored in the non-volatile memory indicates that a reel was spinning when just prior to the power failure, that reel will be respun upon power up. The control unit also monitors opening of the door providing access to the reel mechanism and causes the reels to respin whenever this door is closed.

8 Claims, 8 Drawing Figures

POKER MACHINE WITH IMPROVED SECURITY AFTER POWER FAILURE

Until recently all poker machines (also known as fruit machines or slot machines) manufactured and marketed around the world were of what is called "the mechanical type". This means that the internal mechanism of such machines was actuated by mechanical means and performed its various functions by a series of mechanical devices. Nearly all such machines were operated by the insertion of a coin which then permitted the player to pull a handle, usually situated on the right hand side of the machine's cabinet.

In recent years electronics have been introduced in varying degrees to assist or in many cases replace the mechanical arrangements of the past. In most cases an electric motor is used to drive the mechanism through its complete game cycle. This has meant that the action of pulling the handle to activate the mechanism is no longer essential as it is now only necessary to operate an electric switch. This switch activates various electronic circuits which in turn activate the electric motor drive system.

Prior art poker machines, both the mechanical type, and those having electrically driven mechanisms, have been susceptible to being fraudulently operated by persons having access to the mechanism of the machine. Fraudulent operation usually consists in opening the machine, manipulating the mechanism to produce a winning combination, closing the machine, and then claiming payment for the combination as though it had been obtained by valid operation of the machine. Poker machines are often fitted with various safety devices to detect fraudulent manipulation and to cause an alarm to be sounded if such manipulation occurs. However, in order to prevent the operation of these safety devices, persons wishing to manipulate a poker machine for fraudulent purposes can stop the operation of the poker machine for a period of time by unplugging the machine from the power supply, during which time the machine may be manipulated without fear of an alarm being initiated by a manipulation detecting device. It would be possible to overcome such manipulation by causing an alarm to operate upon power failure, or upon resumption or power to a machine, however, such an arrangement would cause all machines in an installation to enter the alarm condition in the event of a genuine power failure or where power is accidentally removed from a machine which would be generally inconvenient and, in the case where power was accidentally removed from an individual machine, such an alarm might cause considerable embarrassment to the person playing the machine at the time.

Further, an alarm system which invalidates a game upon accidental power loss will cause considerable annoyance to players who might have already had a winning combination showing at the time when the power loss occurred. It is highly desirable, therefore, to attempt to distinguish between accidental power loss and fraudulent operation of the machine and, after a power loss, to re-establish conditions in the machine as closely as possible to those existing prior to the occurrence of the power loss.

Prior art slot or poker machines are also known in which a microprocessor monitors and controls the operation of the machine mechanism. Examples of such prior art are given in U.S. Pat. No. 4,095,795 to Saxton and U.S. Pat. No. 4,240,635 to Brown.

The present invention consists in an electrically operated poker machine comprising a plurality of rotatable reels each carrying a plurality of indicia about their periphery, means for spinning the reels, individually or together, in response to electrical signals initiated by control means, means for determining the current status of said reels and alarm means responsive to said control means, said control means including non-volatile memory means adapted to store the current status of each of said reels, said control means being adapted to examine the current status of said reels upon resumption of power after a power loss and to compare the current status with a status stored in the non-volatile memory prior to the power loss to determine whether any reel which was stopped prior to the power loss has subsequently moved and if such movement has occurred to cause said alarm means to signal an alarm condition.

According to another aspect, the present invention consists in a method of controlling a poker machine having a plurality of rotatable reels each carrying a plurality of indicia about their periphery, means for spinning the reels, individually or together in response to electrical signals initiated by control means, means for determining the current status of said reels and alarm means responsive to said control means, and said control means including non-volatile memory means adapted to store the current status of each of said reels, the method including the steps of (a) during normal operation of the machine, periodically testing the status of the reels and updating the contents of the non-volatile memory; and (b) during initialization after power up:

(i) testing the current status of the reels;

(ii) comparing the current status of the reels with the status stored in the non-volatile memory; and (iii) if the comparison indicates that a reel, that was stationary when the status was last stored in the non-volatile memory, has subsequently moved, initiate an alarm signal.

In a preferred embodiment of the invention, the control means also determines which reels were spinning when the power loss occurred and re-spins those reels.

Variations of the present invention may be used in poker machines wherein the reels are driven by stepping motors, or wherein the reels are spun by the operation of a solenoid and stopped by a rachet device which may be engaged by the action of another solenoid or a motor driven cam.

Preferred embodiments of the present invention will also cause the reels to re-spin upon closure of the poker machine door. The reels are then tested before playing of the machine is allowed and if a winning combination appears on the reels, they will be re-spun again and the procedure repeated until no winning combination appears.

Many poker machines of contemporary design have all the hardware required to provide the features of the present invention and only require the control circuit to be adapted to perform the required sequence of operations. In particular, most poker machines which are controlled by microprocessors require only a change to the control programme contained in read-only-memory (ROM).

An embodiment of the invention will now be described by way of example with reference to the accompanying drawings in which.

Figure 1:
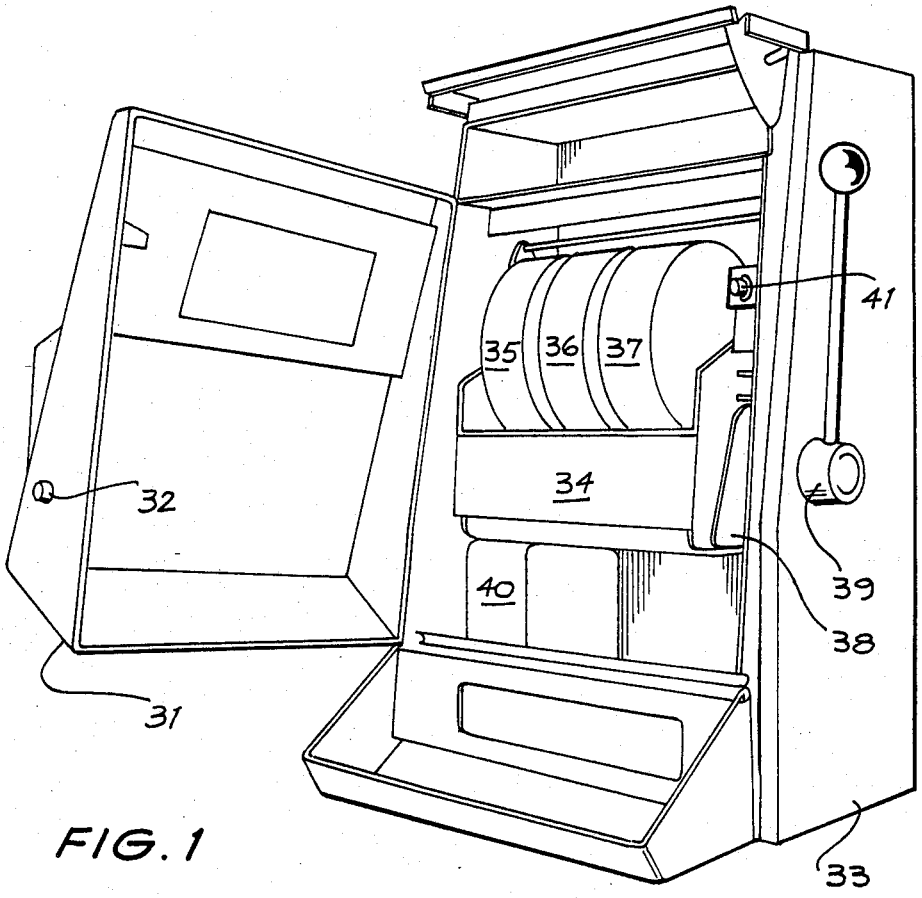
FIG. 1 illustrates a typical poker machine with its door opened to reveal the internal mechanism.
Figure 3:
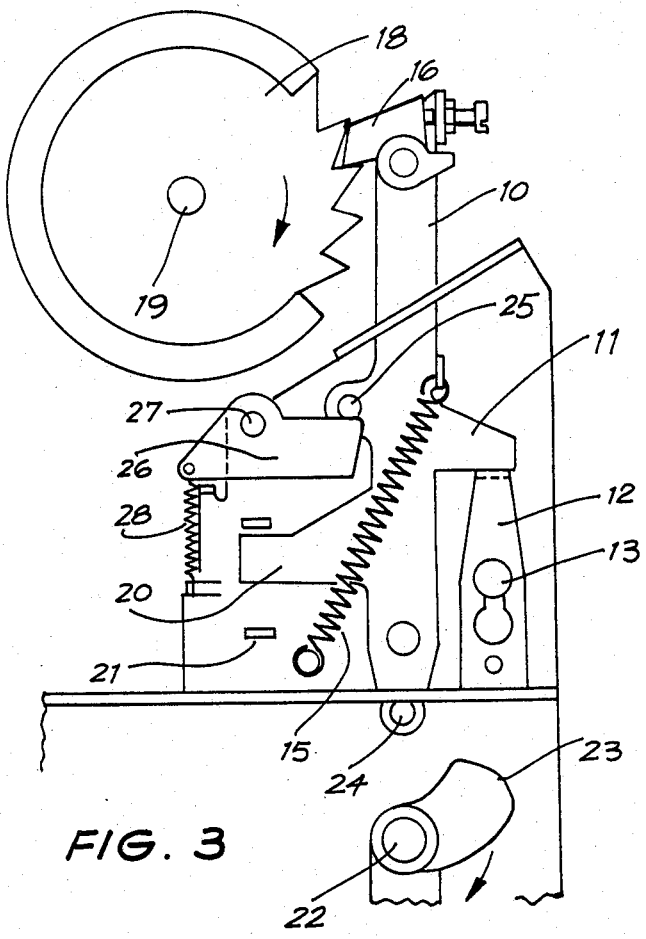
Figure 3A:
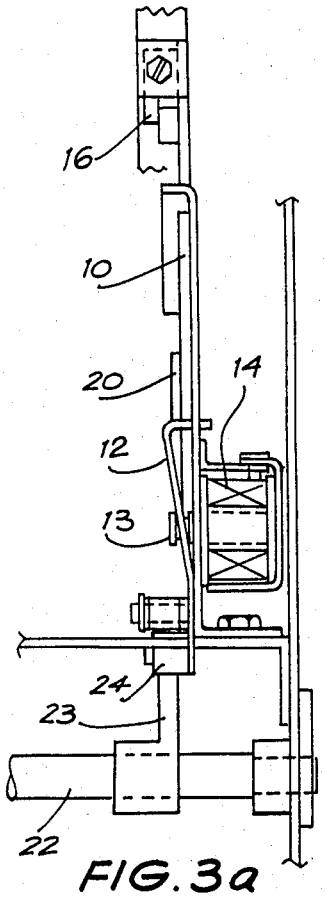
Figure 4:
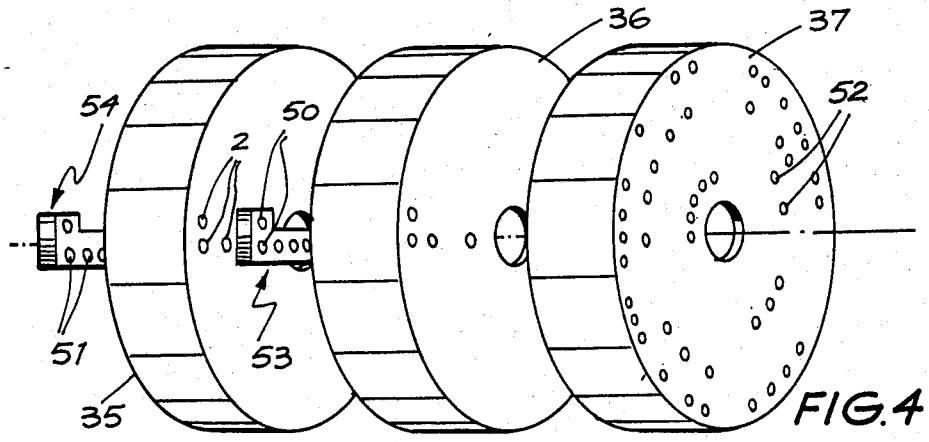
Figure 5:
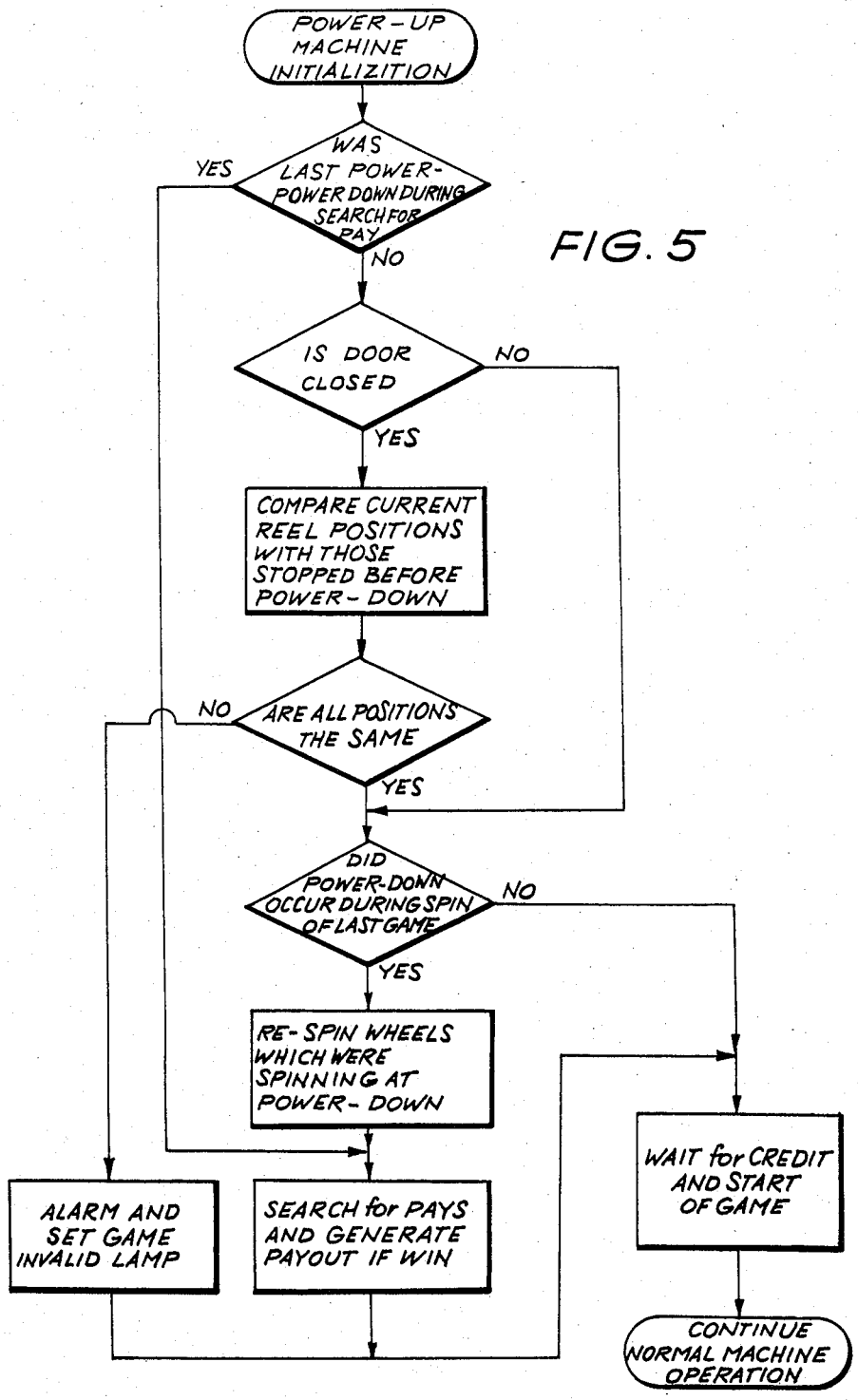
Figure 6:
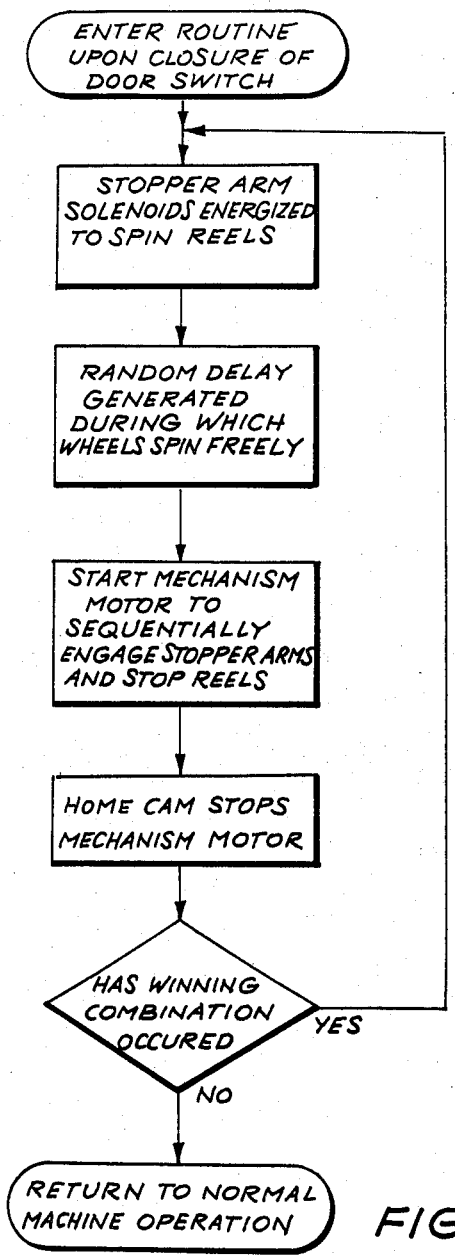
Figure 7:
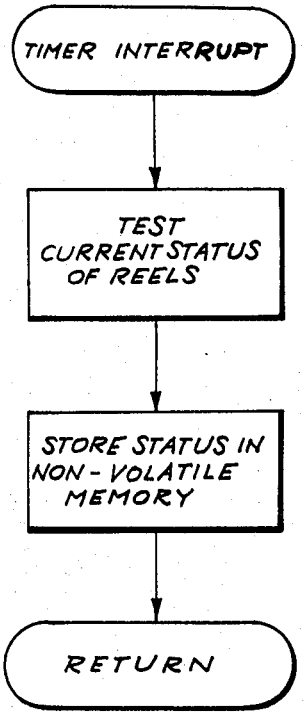

FIGS. 3 and 3*a* illustrate a reel mechanism typical of that which might be found in the poker machine of FIG. 1;

FIG. 4 illustrates a typical method of detecting the position of reels in the mechanism of a poker machine;

FIG. 5 illustrates a program sequence, in flow chart form, which is used to achieve the present invention in a poker machine of the type described;

FIG. 6 illustrates a program sequence, in flow chart form, which is used to achieve respinning of the reels after door closure in a preferred embodiment of the invention; and FIG. 7 illustrates a program sequence, in flow chart form which is used to update the non-volatile status memory.

The poker machine of FIG. 1 has a door 31 fitted to a housing 33 and provided with a lock 32, which locks the door when in the closed position. When the door is opened the mechanism 34 of the poker machine is revealed. Three reels 35, 36 and 37 which are mounted coaxially and rotatably in the mechanism are provided with a reel spinning means (refer to FIG. 3) and stopper arms for each reel.

Figure 2:
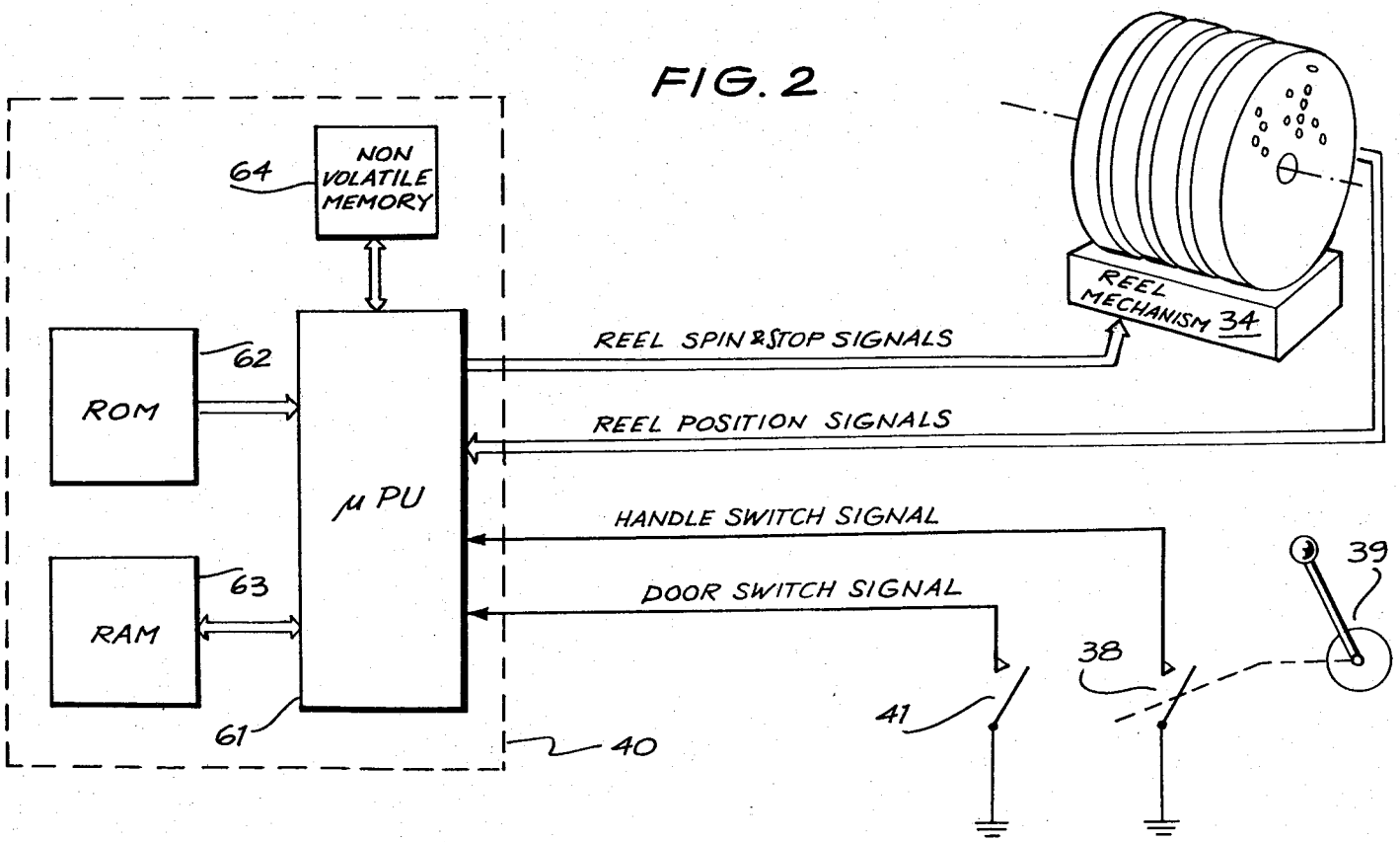
FIG. 2 illustrates a block diagram of the poker machine of FIG. 1.

Referring to FIG. 2, the control unit 40 of the poker machine includes a microprocessor 61, a ROM 62 containing a stored program which is executed by the microprocessor to control the poker machine, RAM 63 which is used to store temporary values during operation of the machine and a non-volatile memory 64 which is used to store data which must not be lost, in the event of a power failure. Typically, the non-volatile memory will be used to store machine statistics such as the number of coins inserted into the machine, the number of coins paid out, etc. The current machine status will also be loaded into the non-volatile memory at regular intervals in order that the machine may recover after a power failure and as part of the information relating to machine status the current state of the reels is stored including whether or not each reel is spinning and if not spinning its current position. This information relating to the state of the reels can be used to determine if the reels have been tampered with while the power has been removed.

Among its many inputs and outputs, the control unit 40 includes outputs which drive the solenoids and motor of the reel mechanism, thereby allowing the reels to be spun under control of the microprocessor 61, and inputs from the reel position sensors, such that the microprocessor 61 can monitor the current state of the reels. Other inputs to the microprocessor includes a signal from the handle switch 38 which is used to initiate game sequences and a signal from the door switch 41 which is used to disable poker machine operation while the machine is opened.

During normal operation of the poker machine, once a player has established a credit in the machine, for example by inserting an appropriate coin or token, the handle 39 can be pulled, closing switch 38 and in turn generating a handle pulled signal to the processor 61. After sensing the closure of the handle switch 38, the processor initiates the spinning of the reels of the reel mechanism 34 and then causes the reels to stop again in succession. Once the reels have stopped, the processor then checks the position at which each reel stops and determines whether the final position of the reels correspond to a winning combination, and if so a payout is initiated, or the player credit is increased by an appropriate amount depending upon the type of poker machine. Once the payout is complete the machine is ready to commence a new game cycle.

Appartus for detecting the positions of the reels is depicted in FIG. 4 wherein a plurality of light sources 50 are positioned on one side of each reel and directed toward corresponding light detectors 51 positioned on the other side of the respective reel. Axially directed holes 52 passing through the reels are radially positioned to pass between one of the light sources 50 and its corresponding light detector 51 when the reel rotates, such that when the hole is positioned between the source and detector light passes through the hole to reach the detector and when the hole is not so positioned, light does not reach the detector.

By using a plurality of hole detectors it is possible to determine in which one of a number of available positions a reel currently rests. FIG. 4 depicts such an arrangement of sensors, wherein a lamp bracket 53 holds five light sources 50—typically infrared light emitting Diodes—and a sensor bracket 54 holds five corresponding light detectors 51—typically Phototransistors or Photodiodes. The reel 35 positioned between the lamp bracket and the sensor bracket has a plurality of holes 52 arranged such that the detectors 51 produce a unique binary code for each rest position of the reel. The positioning of the holes 52 may best be seen on reel 37 which is depicted without the lamp and sensor brackets for clarity.

Returning to FIG. 1 the poker machine is fitted with a control circuit 40 the heart of which is a microprocessor 61 and a ROM 62. Contained in the ROM is a control programme which sequences the operations of the microprocessor, and hence the control circuit, in order that it might in turn control the functions of the poker machine.

The poker machine is fitted with a door operated switch 41 and a game initiating switch 38 operated by a handle 39. Both of these switches are connected to the control circuit 40 and provide inputs to the microprocessor control programme as do the signals from the reel position detectors. Signals generated by the control circuit, as a result of outputs from the microprocessor control programme, are used to control the release of reel stopper arms which control the motion of the reels, and a mechanism motor which in turn controls the re-engagement of the stopper arms to stop the reels.

Referring to FIG. 3, the pawl means constituted by the stopper arm 10 is held in the engaged, i.e. "stopped" position by virtue of its upper horizontal integral leg 11 resting on the top face of the stopper arm release lever 12 (see FIG. 3*a*).

To commence a game it is necessary to spin the reels, usually simultaneously, and to achieve this with the mechanism of the present embodiment is extremely simple. The stopper arm release lever 12 is connected to a solenoid armature 13 (FIG. 3*a*) and therefore when the solenoid 14 is energised the release lever 12 is moved inwards towards the solenoid 14.

This movement removes the support from under the upper horizontal leg 11 of the stopper arm 10 allowing it to drop under the influence of the stopper arm spring 15. The sharp vertical downwards movement of the stopper arm 10 causes the stopper head 16, which is engaged with the teeth of the toothed sprocket 18 attached to the reel (not shown), to give the sprocket a sharp pull or kick which causes the reel to spin on its axle 19. In order to disengage the stopper head 16 at the end of its vertical stroke to allow the reel to spin freely the lower integral leg 20 of the stopper arm hits the lower limit stop 21. This causes the stopper head 17 to move away from the toothed sprocket 18 and therefore disengage from it.

Mounted immediately below the stopper arm 10 is an electrically driven camshaft 22, which has a series of cams such as 23 attached to it. Each cam 23 being so positioned that it is in line with a roller 24 mounted on the lower end of each stopper arm 10. After a predetermined, possibly random, time has elapsed, the cam 23 rotates, engages the roller 24 and moves the stopper arm 10 upwards. A pin 25 mounted on the stopper arm now comes into engagement with the front face of the trip lever 26. On the way down the stopper arm pin 25 trips over the trip lever 26 because it is pivoted at 27 and spring loaded by the spring 28 in such a way as to allow this.

As the stopper arm 10 is moved upwards by the cam 23 the engagement of the pin 25 against the face of the trip lever 26 keeps the stopper arm head 17 from engaging with the toothed sprocket 18 attached to the reel until it is almost at the top of its stroke. When the stopper arm 10 reaches a position where the pin 25 can go over the trip lever 26 the stopper arm 10 is pulled towards the toothed sprocket 18 under the influence of the stopper arm spring 15 causing the stopper arm head 17 to again engage the toothed sprocket 18 and so to stop the reel from spinning. At the same time the upper horizontal leg 11 of the stopper arm has been lifted above the stopper arm release lever 12. This lever, now no longer under the influence of the solenoid, springs back under the horizontal leg 11 and prevents the arm from dropping again until the next game.

The reason for the delay in allowing the stopper head to re-engage with the spinning toothed sprocket on the return stroke is to achieve a sudden engagement rather than a gradual one. This achieves a sharp and positive stopping action of the reel which is a desirable feature on a poker machine.

The cams 23 are so arranged on the camshaft 22 that during one complete cycle of the camshaft all the stopper arms operated in the desired sequence to stop all the reels in turn.

When a "hold and draw" feature is required, that is the ability to prevent one or more reels spinning when commencing a game, or when for some other reason not all of the reels are required to be spun, this is achieved by simply not energising the appropriate solenoids which prevents those reels from getting the necessary "kick" to spin them.

Turning to FIG. 7, a flow chart of a timer interrupt routine is illustrated. This routine is entered periodically during normal operation of the machine and causes the current status of the reels to be stored in the non-volatile memory 64. The information stored in the memory 64 includes the position of any reel that has stopped as well as an indication of those reels which are still spinning.

Referring now to FIG. 5, a flow chart of the power-up routine is illustrated, wherein the procedure providing the security features of the present invention is embodied. This procedure commences by testing whether the machine was searching for a pay when power down occurred and if so, the routine recommences by completing the search for pays. Otherwise the routine checks that the poker machine door is closed and if so, a comparison is made of the current reel positions with those of the reels which had been stopped prior to the power loss. When any of the reels are not in the position in which they had been prior to power loss, an alarm condition is signalled and the game invalid lamp is lit, prior to returning to the normal machine operating procedure. If all of the previously stopped reels are still in the same position, a further test is made to determine if any reels were still spinning at the time of the power failure and if so those reels are re-spun and randomly stopped in the normal manner. Once all of the reels are stopped, a search for pays is conducted and a payout generated if any winning combination occurs. The machine then waits for a player credit to be established, if one does not already exist and then commences normal operation when a new game begins.

In the preferred embodiment a program sequence is also provided which will cause the reels to re-spin upon closure of the poker machine door. This function of the machine is provided by way of a procedure which is initiated when the microprocessor detects the operation of the door operated switch upon closure of the door of the poker machine, and the sequence of operations, illustrated in FIG. 6, which form the procedure are as follows:

(a) Door operated switch operates on closure of the door and causes entry of re-spin rountine;

(b) The stopper arm solenoids are energised causing the stopper arms to pull the sprocket wheel before disengaging from the sprocket wheel.

(c) A random variable delay is generated by the microprocessor and reels spin freely with stopper arms held clear until the delay period has elapsed.

(d) Upon elapsing of the delay period, the controller starts the mechanism motor thereby causing the cams to be driven by the mechanism motor to move the stopper arms into engagement with the sprocket wheels to stop the reels one at a time.

(e) When all reels have stopped and the game cycle is ended, a home cam stops the mechanism motor.

(f) The microprocessor tests signals from the reel position detectors to determine whether a winning combination occurs.

(g) If a winning combination occurs, the microprocessor programme returns to step b.

(h) If no winning combination occurs microprocessor reverts to its normal operating procedure.

It will be recognised by persons skilled in the art that numerous variations and modifications may be made to the invention as hereinbefore described without departing from the spirit or scope of the invention as broadly described.

I claim:

1. An electrically operated poker machine comprising a plurality of rotatable reels each carrying a plurality of indicia about their periphery, means for spinning the reels, individually or together, in response to electrical signals initiated by control means, means for determining current status of said reels and alarm means responsive to said control means, said control means including non-volatile memory means for storing the current status of each of said reels, said control means including means to examine the current status of said reels upon resumption of power after a power loss and to compare the current status with a status stored in the non-volatile memory prior to the power loss to determine whether any reel which was stopped prior to the power loss has subsequently moved and if such movement has occurred to cause said alarm means to signal an alarm condition.

2. The poker machine of claim 1 wherein the control means including means to determine from the status stored in the non-volatile memory, which reels were spinning prior to the power loss and to respin those reels upon the resumption of power.

3. The poker machine of claim 2 wherein the switch means are provided, the switch means operating in response to closure of a door providing access to said reels to initiate a signal to the control means and the control means including means to spin the reels in response to closure of said door.

4. The poker machine of claim 3 wherein the control means includes means to test position of the reels after they have been spun in response to a door closure and to respin the reels again if the position represents a winning combination of the machine.

5. A method of controlling a poker machine having a plurality of rotatable reels each carrying a plurality of indicia about their periphery, means for spinning the reels, individually or together in response to electrical signals initiated by control means, means for determining current status of said reels and alarm means responsive to said control means, and said control means including non-volatile memory means for storing the current status of each of said reels, the method including the steps of (a) during normal operation of the machine, periodically testing the current status of the reels and updating the contents of the non-volatile memory; and (b) during initialization after power up:

(i) testing the current status of the reels;

(ii) comparing actual status of the reels with the status stored in the non-volatile memory; and (iii) if the comparison indicates that a reel that was stationary when the current status was last stored in the non-volatile memory, has subsequently moved, initiating an alarm signal.

6. The method of claim 5 wherein, if the stored status indicates that a reel was moving when the current status was last stored, a signal is initiated to respin the respective reel.

7. The method as claimed in claim 6 wherein the poker machine has a switch, responsive to closure of a door providing access to said reels, to initiate a signal to the control means upon closure of the door and the method includes the step of spinning the reels in response to an occurrence of said signal.

8. The method of claim 7 wherein, after spinning the reels in response to the occurrence of said signal, the control means tests the reels for winning combinations and if a winning combination occurs, the reels are respun and retested, spinning and testing steps being repeated until a non-winning combination occurs.

* * * * *